US009857758B2

(12) United States Patent
Kozushi

(10) Patent No.: US 9,857,758 B2
(45) Date of Patent: Jan. 2, 2018

(54) POSITIONING STRUCTURE, COMPONENT INSTALLATION STRUCTURE, AND IMAGE FORMING APPARATUS

(71) Applicant: FUJI XEROX CO., LTD., Tokyo (JP)

(72) Inventor: Takehiro Kozushi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 118 days.

(21) Appl. No.: 14/458,853

(22) Filed: Aug. 13, 2014

(65) Prior Publication Data

US 2015/0248103 A1 Sep. 3, 2015

(30) Foreign Application Priority Data

Mar. 3, 2014 (JP) ..... 2014-040425

(51) Int. Cl.
*G03G 21/16* (2006.01)
*G03G 21/18* (2006.01)

(52) U.S. Cl.
CPC ..... *G03G 21/1619* (2013.01); *G03G 21/1647* (2013.01); *G03G 21/185* (2013.01); *G03G 21/1842* (2013.01); *G03G 21/1864* (2013.01); *G03G 2215/0132* (2013.01)

(58) Field of Classification Search
CPC ..... G03G 21/1619; G03G 21/1842; G03G 21/185; G03G 21/1864; G03G 21/1647; G03G 2215/0132
See application file for complete search history.

(56) References Cited

U.S. PATENT DOCUMENTS

2002/0085854 A1* 7/2002 Numagami ..... G03G 21/185 399/90
2008/0060395 A1* 3/2008 Hanisch ..... E05B 85/02 70/237
2011/0052251 A1* 3/2011 Kondo ..... 399/107

FOREIGN PATENT DOCUMENTS

| | | |
|---|---|---|
| JP | A-61-74735 | 4/1986 |
| JP | H03-033870 A | 2/1991 |
| JP | A-8-10867 | 1/1996 |
| JP | A-8-232944 | 9/1996 |
| JP | 2002-268506 A | 9/2002 |
| JP | 2006-084958 A | 3/2006 |
| JP | 2006-285124 A | 10/2006 |
| JP | 2008-129447 A | 6/2008 |
| JP | 2010-175926 A | 8/2010 |

OTHER PUBLICATIONS

Sep. 13, 2017 Office Action issued in Korean Patent Application No. 10-2014-0134109.
Oct. 18, 2017 Office Action issued in Japanese Patent Application No. 2014-040425.

* cited by examiner

*Primary Examiner* — Joseph S Wong
(74) *Attorney, Agent, or Firm* — Oliff PLC

(57) ABSTRACT

Provided is a positioning structure into which a positioning protrusion provided at a member is inserted and which positions the member, wherein a metal plate is provided with a hole which is processed to have a shape protruding toward the positioning protrusion to be inserted therein and whose tip end portion on the protruding side has an increasing diameter toward a tip end and into which the positioning protrusion is inserted.

15 Claims, 12 Drawing Sheets

POSITIONING STRUCTURE, COMPONENT INSTALLATION STRUCTURE, AND IMAGE FORMING APPARATUS

CROSS-REFERENCE TO RELATED APPLICATIONS

This application is based on and claims priority under 35 USC 119 from Japanese Patent Application No. 2014-040425 filed Mar. 3, 2014.

BACKGROUND

Technical Field

The present invention relates to a positioning structure, a component installation structure, and an image forming apparatus.

SUMMARY

According to an aspect of the invention, there is provided a positioning structure into which a positioning protrusion provided at a member is inserted and which positions the member, wherein a metal plate is provided with a hole which is processed to have a shape protruding toward the positioning protrusion to be inserted therein and whose tip end portion on the protruding side has an increasing diameter toward a tip end and into which the positioning protrusion is inserted.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described.

Figure 1:
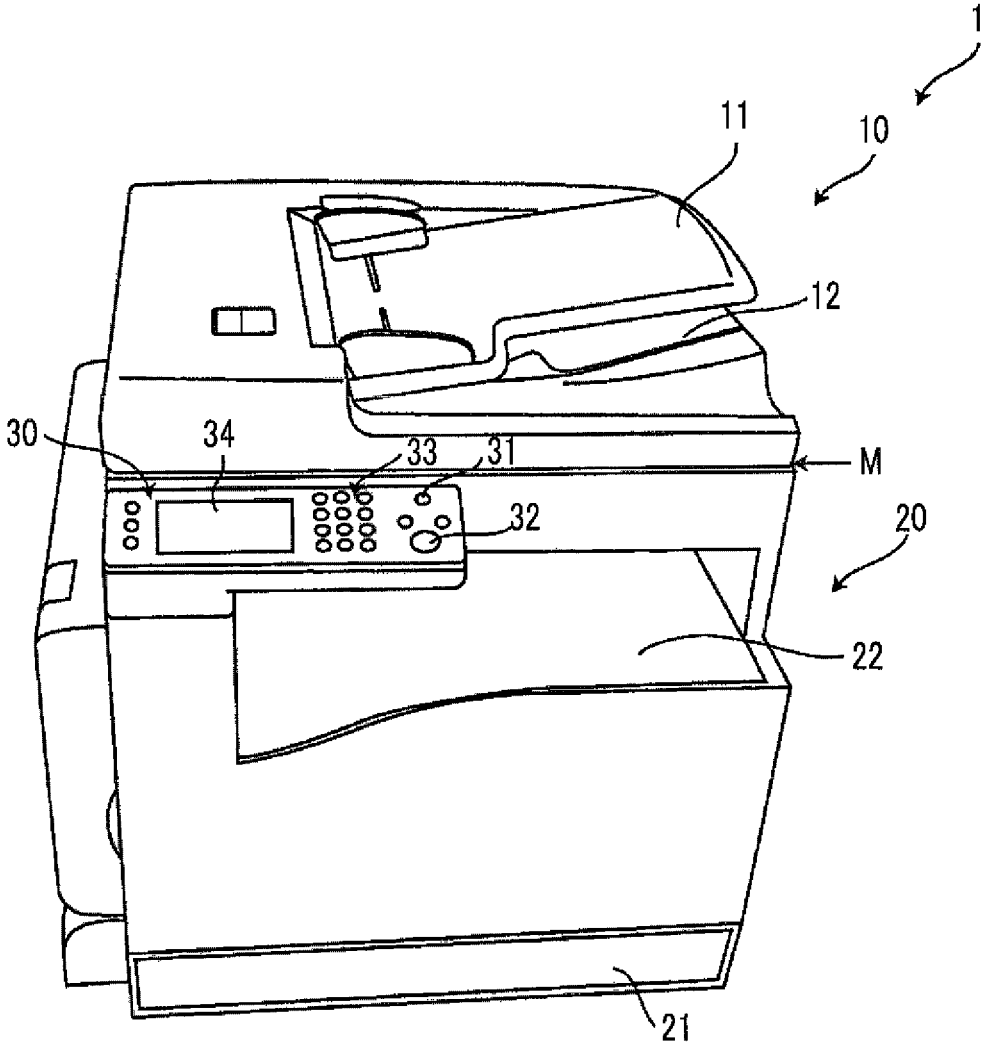
FIG. 1 is an exterior perspective view of an image forming apparatus according to an exemplary embodiment of the invention.

FIG. 1 is an exterior perspective view of an image forming apparatus according to an exemplary embodiment of the invention.

An image forming apparatus 1 includes a scanner 10 and a printer 20.

The scanner 10 is a device which reads an image drawn on a document so as to generate an image signal. In addition, the printer 20 prints and outputs the image based on the image signal on a paper sheet.

The scanner 10 is provided with a document tray 11 and a document discharge tray 12. When a start button 32 is pressed in a state in which documents are placed on the document tray 11 in a stacked manner, the documents are sequentially fed one by one so as to be read, and are discharged onto the document discharge tray 12. In addition, a hinge (not illustrated) which extends in a horizontal direction is provided inside the scanner 10, and thus an upper portion of an arrow M may be lifted to open. A transparent glass plate 13 (refer to FIG. 2) spreads directly under the arrow M. When a single document is placed downwardly on the transparent glass plate 13, and the start button 32 is pressed in a state in which the upper portion of the arrow M is closed, the document on the transparent glass plate 13 may be read.

In addition, the printer 20 is a device which sequentially extracts paper sheets stacked in a paper tray 21 one by one, and prints an image based on an image signal on the extracted paper sheet. The paper sheet on which the image is printed is discharged onto a paper discharge tray 22. In the present exemplary embodiment, the printer 20 is a printer which prints and outputs an image on a paper sheet in a so-called electrophotographic method.

In addition, the image forming apparatus 1 includes a user interface (UI) 30. The UI 30 is provided with a power button 31, the start button 32, plural press buttons 33, and a touch panel type display screen 34. The UI 30 is operated, and thus various instructions such as an instruction for the number of prints or an instruction for starting an operation are performed. Further, the display screen 34 displays a state of the apparatus or various press buttons. The press buttons 34 displayed on the display screen 34 are targets of operations.

Figure 2:
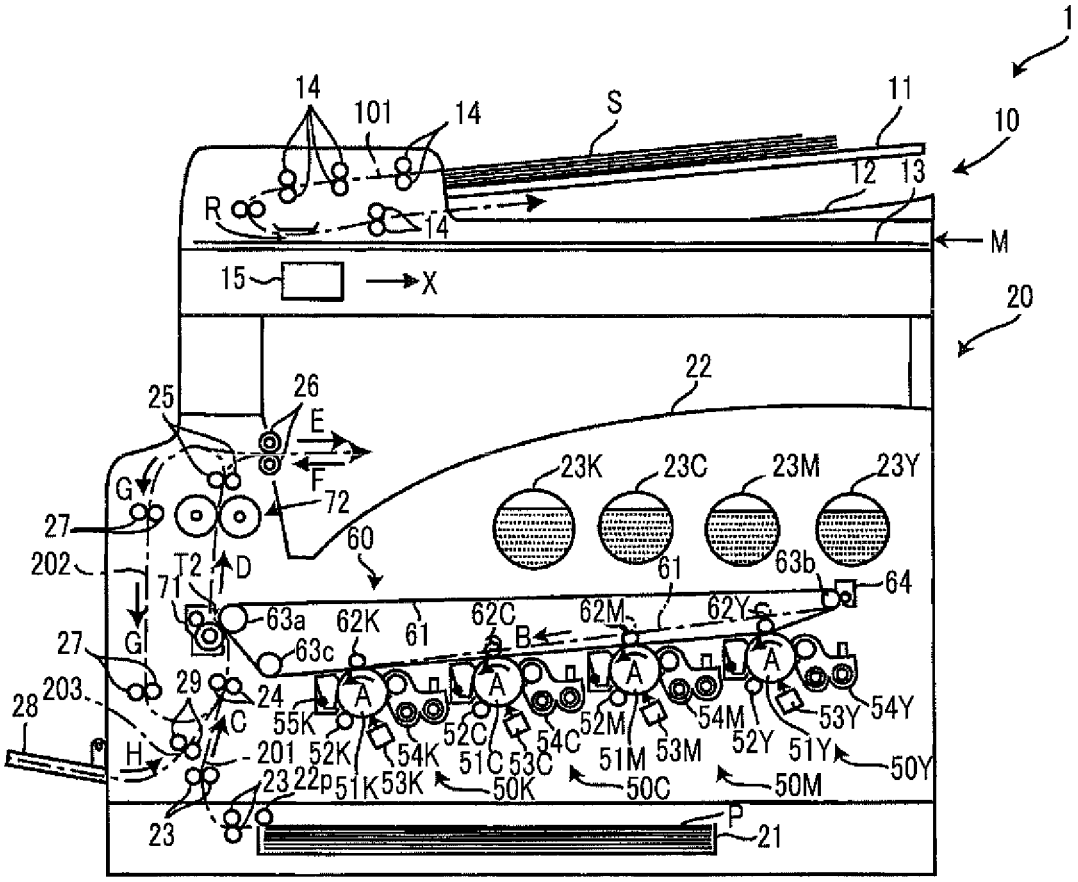
FIG. 2 is a schematic diagram illustrating an internal configuration of the image forming apparatus whose exterior is illustrated in FIG. 1.

FIG. 2 is a schematic diagram illustrating an internal configuration of the image forming apparatus whose exterior is illustrated in FIG. 1.

When the start button 32 (refer to FIG. 1) is pressed, documents S placed on the document tray 11 of the scanner 10 are fed one by one so as to be transported along a transport path 101 by transport rolls 14, and are discharged onto the document discharge tray 12 after passing through a reading position R which is in contact with the transparent glass plate 13 in the course of the transport. In addition, when the document S passes through the reading position R, an image recorded on the document S is read by a reader 15 which faces and stops at the reading position R, so as to be converted into an image signal.

Further, a paper sheet is placed downwardly on the transparent glass plate 13 in a state in which the upper portion of the arrow M is opened, and the start button 32 is pressed in a state in which the upper portion is closed. At this time, the reader 15 is moved in an arrow x direction, and reads the document on the transparent glass plate 13 so as to perform conversion into an image signal.

The printer 20 includes four image forming units 50Y, 50M, 50C and 50K which are arranged in a line approximately transversely. The image forming units 50Y, 50M, 50C and 50K are image forming units which form toner images by respectively using color toner including yellow (Y), magenta (M), cyan (C) and black (K). Here, in description common to the image forming units 50Y, 50M, 50C and 50K, the reference signs Y, M, C and K for differentiating colors of toner from each other are omitted, and the image forming unit (s) 50 is (are) denoted. This is also the same for constituent elements other than the image forming units.

A photoconductor 51 is provided in each of the image forming units 50. The photoconductor 51 is rotated in an arrow A direction by a driving force, and, in this state, an electrostatic latent image is formed on a surface thereof, and further a toner image is formed through development.

A charger 52, an exposure device 53, a developer device 54, a primary transfer device 62, and a cleaner 55 are provided in the periphery of the photoconductor 51 constituting each of the image forming units 50. Here, an intermediate transfer belt 61 described later is located at a position to be interposed between the primary transfer device 62 and the photoconductor 51. The primary transfer device 62 is not included in the image forming unit 50, and is included in an intermediate transfer unit 60 described later.

The charger 52 uniformly charges the surface of the photoconductor 51.

The exposure device 53 irradiates the uniformly charged photoconductor 51 with exposure light which is modulated based on an image signal, so as to form an electrostatic latent image on the photoconductor 51.

The developing device 54 develops the electrostatic latent image formed on the photoconductor 51 with toner having a color corresponding to each of the image forming units 50Y, 50M, 50C and 50K, so as to form a toner image on the photoconductor 51.

The primary transfer device 62 transfers the toner image formed on the photoconductor 51 onto the intermediate transfer belt 61 described later.

The cleaner 55 removes remaining toner or the like on the photoconductor 51 after the transfer is performed, from the photoconductor 51.

Here, in the image forming apparatus 1 of the present exemplary embodiment, a single module including the photoconductor 51, the charger 52, and the cleaner 55 is provided in each of the image forming units 50Y, 50M, 50C and 50K. Herein, this module is referred to as a photoconductor module. The photoconductor module is attachably and detachably installed at an apparatus housing (not illustrated) which is a framework of the image forming apparatus 1.

In addition, the exposure device 53 also forms a single module for each of the image forming units 50Y, 50M, 50C and 50K. Herein, this module is referred to as the exposure module.

Further, the developing device 54 also forms a single module for each of the image forming units 50Y, 50M, 50C and 50K. Herein, this module is referred to as a developing module. The exposure module and the developing module are also respectively attachably and detachably installed at the apparatus housing of the image forming apparatus 1.

The intermediate transfer unit 60 is proved over the four image forming units 50. In addition, the intermediate transfer unit 60 is provided with the intermediate transfer belt 61. The intermediate transfer belt 61 is supported by plural rolls such as a driving roll 63*a*, a following roll 63*b*, and a tension roll 63*c*. Further, the intermediate transfer belt 61 is driven by the driving roll 63*a* and is moved in a circulation manner in an arrow B direction on a circulation path including a path along the four photoconductors 51 forming the four image forming units 50Y, 50M, 50C and 50K.

The toner images of the respective photoconductors 51 are transferred onto the intermediate transfer belt 61 so as to sequentially overlap each other due to an operation of the primary transfer device 62. In addition, the toner images transferred onto the intermediate transfer belt 61 is transported to a secondary transfer position T2 by the intermediate transfer belt 61. A secondary transfer device 71 is provided at the secondary transfer position T2, and the toner images on the intermediate transfer belt 61 is transferred onto a paper sheet P which is transported to the secondary transfer position T2, due to an operation of the secondary transfer device 71. The transport of the paper sheet P will be described later. Toner and the like which remain on the intermediate transfer belt 61 after the toner images are transferred onto the paper sheet P are removed from the intermediate transfer belt 61 by a cleaner 64.

Here, the printer 20 has a monochrome mode in which a monochrome image is printed on the paper sheet P by using only the image forming unit 50K which forms a toner image with the black (K) toner and is located at one end (the leftmost end of FIG. 2) of the arrangement, and a color mode in which a color image is printed on the paper sheet P by using the four image forming units 50Y, 50M, 50C and 50K. The intermediate transfer belt 61 changes its circulation movement path so as to be moved while coming into contact with the four photoconductors 51 constituting the four image forming units 50Y, 50M, 50C and 50K in the color mode, and to be moved while coming into contact with only the photoconductor 51K of the image forming unit 50K located one end (the leftmost end of FIG. 2) of the arrangement and being separated from the photoconductors 51Y, 51M and 51C of all the other image forming units 50Y, 50M and 50C in the monochrome mode. In the monochrome mode, it is possible to save power or lengthen the lifetime of the components by stopping operations of all the other image forming units 50Y, 50M and 50C excluding the image forming unit 50K.

Toner cartridges 23K, 23C, 23M and 23Y storing toner having the respective colors are provided over the intermediate transfer unit 60. If the toner in the developing device 54 is consumed due to development, the developing device 54 is replenished with toner from the toner cartridges 23 K, 23C, 23M and 23Y each of which stores the toner having a corresponding color. The toner cartridges 23K, 23C, 23M and 23Y are attachably and detachably constituted, and are extracted when empty, and a new toner cartridge 23 is installed.

In addition, the paper tray 21 is provided on a lower side of the printer 20. The paper sheets P on which printing is not performed are accommodated in the paper tray 21 in a stacked manner. The paper tray 21 is constituted to be freely drawn in order to replenish or exchange paper sheets.

A single paper sheet P is extracted from the paper tray 21 by a pickup roll 22*p*, and is transported to timing adjustment rolls 24 in an arrow C direction along a transport path 201 by transport rolls 23. The paper sheet P which is transported to the timing adjustment rolls 24 is sent to the secondary transfer position so as to arrive at the secondary transfer position T2 by the timing adjustment rolls 24 in accordance with a timing at which the toner image on the intermediate transfer belt 61 arrives at the secondary transfer position T2. The toner image is transferred from the intermediate transfer belt 61 onto the paper sheet P sent by the timing adjustment rolls 24 at the secondary transfer position T2 due to an operation of the secondary transfer device 71. The paper sheet P onto which the toner image is transferred is further transported in an arrow D direction and passes through a fixing device 72. The toner image on the paper sheet P is heated and pressurized so as to be fixed to the paper sheet P by the fixing device 72. Accordingly, an image formed by the fixed toner image is printed on the paper sheet P. The paper sheet to which the toner image is fixed by the fixing device 72 is further transported by transport rolls 25 so as to be sent onto the paper discharge tray 22 by paper discharge rolls 26.

In addition, the printer 20 has a duplex print mode in which images are printed on both sides of the paper sheet P. In the duplex print mode, an image is printed on a first surface of the paper sheet P as mentioned above, and then the paper sheet P of which the images are printed on the first surface is sent halfway toward the paper discharge tray 22 by the paper discharge rolls 26. Further, the paper discharge rolls 26 reverse their rotation directions so as to draw back the paper sheet P which is sent halfway on the paper discharge tray 22.

The paper sheet P which is drawn back due to the reverse rotation of the paper discharge rolls 26 is transported along a transport path 202 in a direction indicated by the arrow G by transport rolls 27 this time, and arrives at the timing adjustment rolls 24 again. At this time, the front surface and rear surface of the paper sheet P are reversed to the time when the image is printed on the first surface. After the paper sheet P arrives at the timing adjustment rolls 24 again, an image is printed on a second surface this time in the same manner as described above. Accordingly, the paper sheet P of which the images are printed on both sides is sent onto the paper discharge tray 22 by the paper discharge rolls 26 this time.

In addition, the printer 20 is provided with an input tray 28. When a paper sheet is placed on the input tray 28, and the start button 32 is pressed, the paper sheet on the input tray 28 is transported along a transport path 203 in an arrow H direction by transport rolls 29, and arrives at the timing adjustment rolls 24. The subsequent printing operation is the same as a printing operation on the paper sheet P extracted from the paper tray 21.

Figure 3:
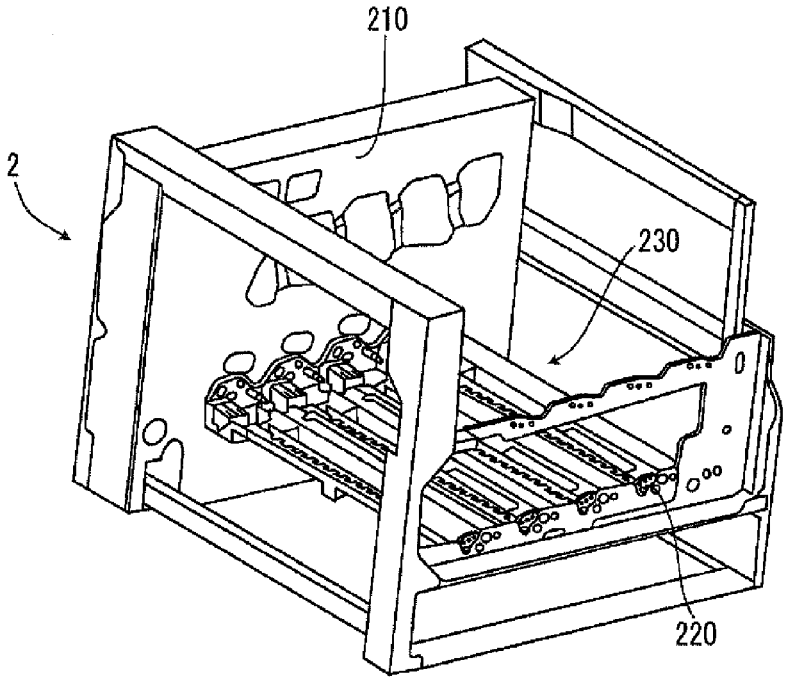
FIG. 3 is a perspective view of a frame member of a printer of the image forming apparatus illustrated in FIGS. 1 and 2.

FIG. 3 is a perspective view of a frame member 2 of the printer of the image forming apparatus illustrated in FIGS. 1 and 2.

Constituent components of the printer 20 are incorporated into this frame member 2, and the scanner 10 is assembled so as to be placed on the frame member 2.

FIG. 3 illustrates a metal plate 210 for component installation, which is fixed inside the frame member 2. Holes for positioning components are formed at the metal plate 210. The metal plate 210 also has a function of electrically grounding installed components. The metal plate 210 corresponds to an example of a metal plate in the claims.

In addition, a single metal plate 220 which is laid in the horizontal direction is fixed to a front side of the frame member 2. The metal plate 220 corresponds to an example of a butting member in the claims.

Further, a guide member 230 made of a resin is laid between the inner metal plate 210 and the front metal plate 220.

Figure 4:
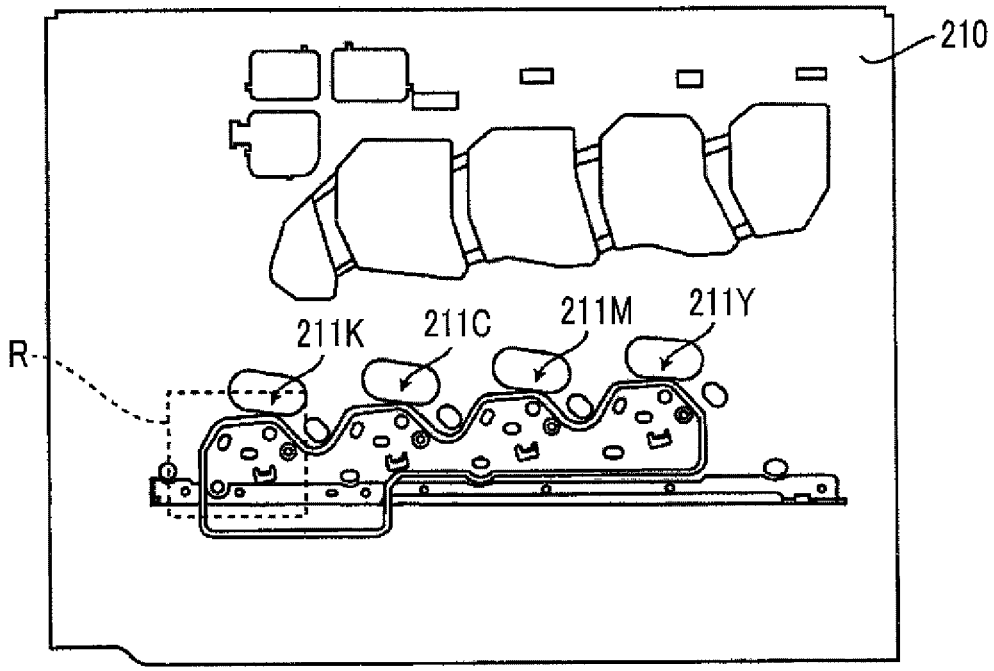
FIG. 4 is a front view of a metal plate fixed inside the frame member.

FIG. 4 is a front view of the metal plate which is fixed inside the frame member.

Here, four positioning portions 211Y, 211M, 2110 and 211K used for positioning the four image forming units 50Y, 50M, 50C and 50K illustrated in FIG. 2 are arranged side by side. The four positioning portions 211Y, 211M, 211C and 211K all have the same structure.

Figure 5:
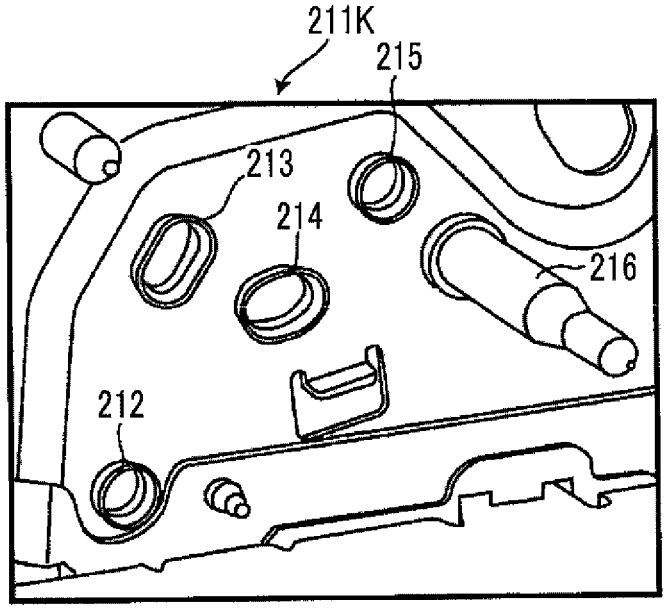
FIG. 5 is a perspective view of a positioning portion of one image forming unit surrounded and indicated by a square R in FIG. 4.

FIG. 5 is a perspective view illustrating a positioning portion of the single image forming unit surrounded and indicated by a square R of FIG. 4.

The positioning portion 211K illustrated in FIG. 5 is a positioning portion used for positioning the image forming unit 50K (refer to FIG. 2) which is located at one end (the leftmost end of FIG. 4) and forms a toner image by using black (K) toner, among the four positioning portions 211Y, 211M, 211C and 211K arranged in FIG. 4. Herein, this single positioning portion 211K will be described as a representative of the four positioning portions 211Y, 211M, 211C and 211K illustrated in FIG. 4.

The positioning portion 211K illustrated in FIG. 5 is provided with four positioning holes 212, 213, 214 and 215. Among the four positioning holes 212, 213, 214 and 215, the two positioning holes 212 and 215 are circular holes, and the remaining positioning holes 213 and 214 are elliptical holes. In addition, a single positioning protrusion 216 which protrudes toward the front side (the metal plate 220 side) of the frame member 2 (refer to FIG. 3) is fixed to the positioning portion 211K.

Figure 6:
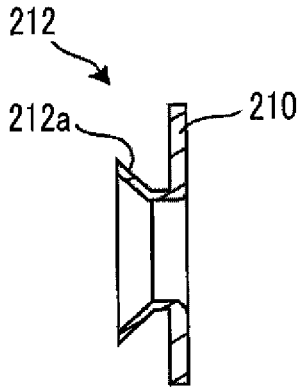
FIG. 6 is a cross-sectional view of one of four positioning holes illustrated in FIG. 5.

FIG. 6 is a cross-sectional view of one of the four positioning holes illustrated in FIG. 5.

The positioning hole 212 illustrated in FIG. 6 is a circular positioning hole which is located at the lower left corner of FIG. 5. In FIG. 6, the left side is a front side, and the right side is inside. The other positioning holes 213, 214 and 215 all have different shapes or dimensions of holes, but a shape characteristic described below is the same as that of the positioning hole 212 illustrated in FIG. 6. Therefore, herein, description will be made of only this single positioning hole 212 and thus will replace description of the four positioning holes 212, 213, 214 and 215.

The positioning hole 212 is a hole which is formed through burring processing in a protruding direction from the inside forward. In addition, in the positioning hole 212, a tip end portion 212*a* on the protruding side is processed in a shape which is open in an increasing diameter toward a tip end.

As mentioned above, in the positioning hole 212, the tip end portion 212*a* is open in an increasing diameter toward the tip end, that is, toward a positioning protrusion of an inserted component. For this reason, even if a component having a considerably great positional displacement is inserted, when a positional displacement of a positioning protrusion of the component is in a range of a diameter of the tip end portion 212*a*, the positioning protrusion is guided to the positioning hole 212 and is correctly inserted thereinto. Therefore, the guide member 230 is not required to have high guide accuracy, that is, the guide member 230 is not required to have high linearity, high rigidness, installation position accuracy, and the like, and, herein, the guide member 230 is made of not a metal but a resin, and thus it is possible to achieve low costs.

FIG. 6 is a diagram illustrating an example of a positioning structure of the present exemplary embodiment of the invention. In other words, FIG. 6 illustrates a positioning structure in which the metal plate 210 is provided with the hole 212 which is burring-processed in a direction protruding toward a positioning protrusion of a positioning target component and whose tip end portion 212*a* is processed to a shape which is open in an increasing diameter toward the tip end and into which the positioning protrusion is inserted. Hereinafter, the positioning structure of the present exemplary embodiment illustrated in FIG. 6 will be described through comparison with comparative examples.

Figure 7A:
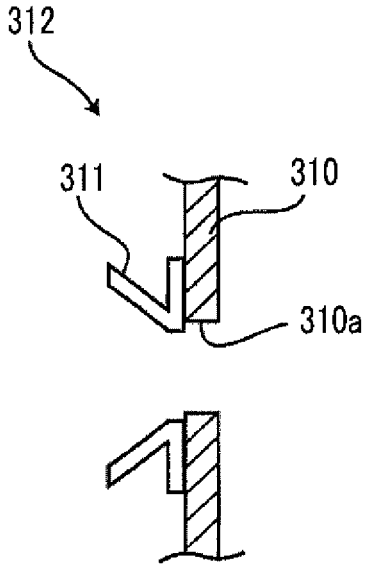
FIGS. 7A and 7B are schematic diagrams illustrating a positioning structure as comparative examples.
Figure 7B:
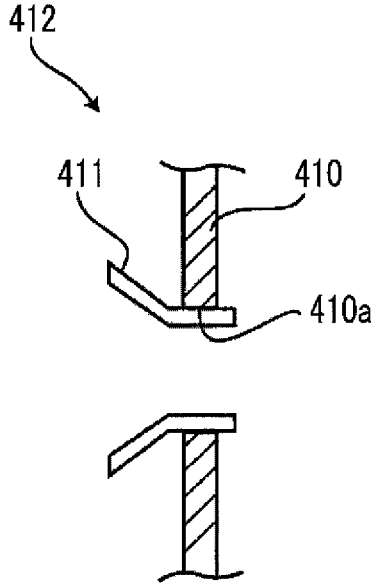

FIGS. 7A and 7B are schematic diagrams illustrating a positioning structure of a comparative example.

FIG. 7A illustrates a positioning structure of Comparative Example 1.

Herein, a positioning structure 312 is illustrated which is formed by two components including a metal plate 310 provided with a positioning hole 310*a*, and an introduction member 311 which introduces a positioning protrusion of a positioning target component into the hole 310*a* and is separate from the metal plate 310. The introduction member 311 preferably employs a resin material from the viewpoint of forming the positioning structure 312 at low costs although a material thereof does not matter.

In addition, FIG. 73 illustrates a positioning structure of Comparative Example 2.

Also, herein, in the same manner as in FIG. 7A, a positioning structure formed by two components including a metal plate 410 and an introduction member 411 separate from the metal plate 410 is illustrated. The introduction member 411 is made of, for example, a resin, in the same manner as the introduction member 311 of FIG. 7A, A positioning hole 410*a* is formed at the metal plate 410, but, in a case of Comparative Example 2 illustrated in FIG. 7B, the introduction member 411 enters the hole 410*a*. For this reason, a positioning protrusion of a positioning target component is positioned at the positioning hole 410*a* of the metal plate 410 in a state of interposing the introduction member 411 therebetween.

Here, in a case of the positioning structure of the present exemplary embodiment illustrated in FIG. 6, through processing of the metal plate 210, a shape is realized in which the tip end portion 212*a* whose front side is opened so as to introduce a positioning protrusion is smoothly continued to the hole portion at which the introduced positioning protrusion is actually positioned. In other words, in the positioning structure of the present exemplary embodiment, a positioning protrusion of a positioning target component is introduced by the single metal plate 210 so as to be guided to the hole 212, to be positioned, and to be held.

In contrast, in a case of Comparative Example 1 illustrated in FIG. 7A, a gap or a step difference tends to occur between the introduction member 311 and the hole 310*a* of the metal plate 310, and thus there is a concern that a positioning protrusion of a component may not be smoothly introduced into the hole 310*a* of the metal plate 310 as compared with the positioning structure of the present exemplary embodiment illustrated in FIG. 6.

In addition, in a case of Comparative Example 2 illustrated in FIG. 7B, a positioning protrusion may be smoothly introduced into the hole 410*a* of the metal plate 410 by the introduction member 411. However, the positioning protrusion is positioned at the hole 410*a* of the metal plate 410 via the introduction member 411. Therefore, there is a concern that positioning accuracy of the positioning protrusion is degraded further than in the structure of the present exemplary embodiment illustrated in FIG. 6, due to a variation in a dimension or a thickness of the introduction member 411.

The description of comparison with the comparative examples is completed, and the present exemplary embodiment will be described again.

Figure 8:
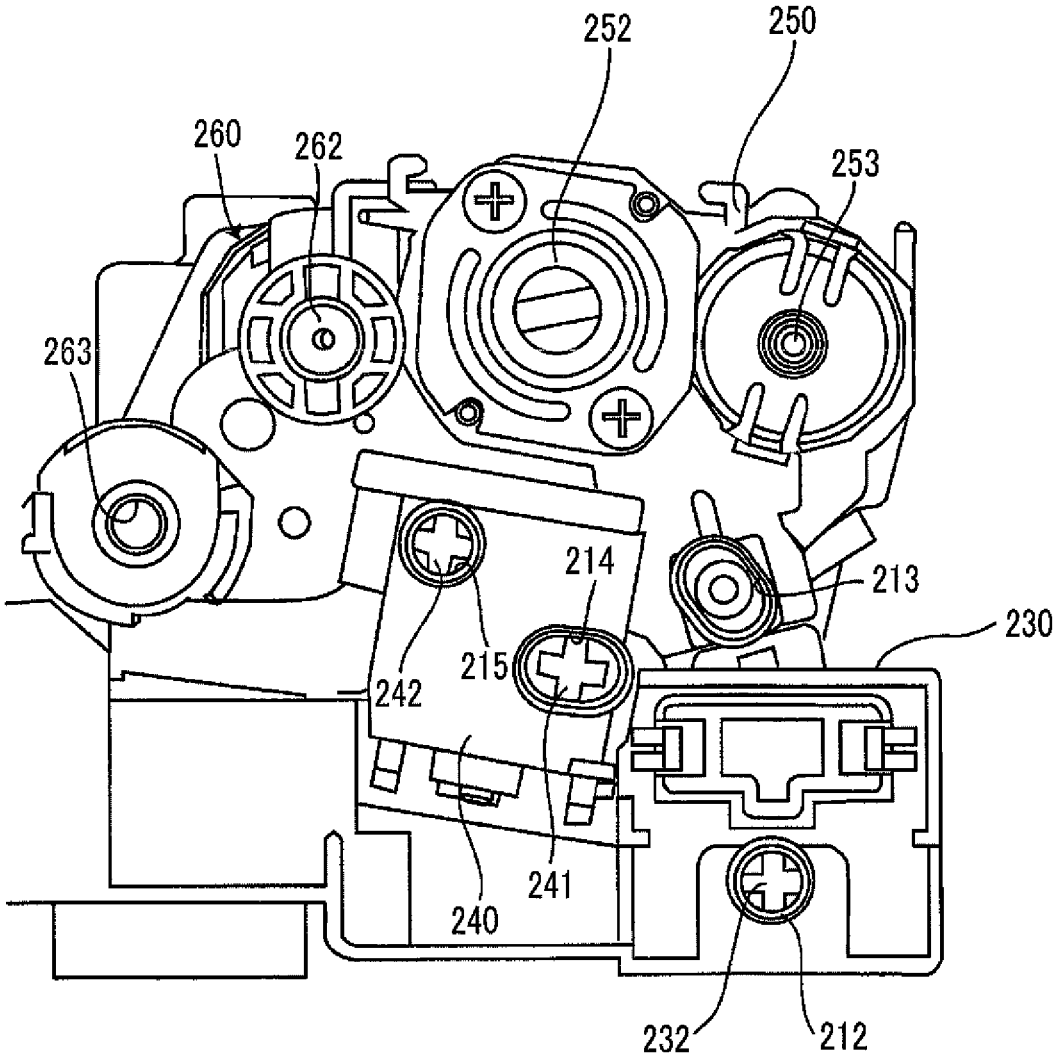
FIG. 8 is a diagram illustrating positional relationships between various modules forming the image forming units and positioning holes provided at an inner metal plate or the like when viewed from a rear side of the apparatus.

FIG. 8 is a diagram illustrating positional relationships between various modules forming the image forming units and the positioning holes provided at the inner metal plate when viewed from the rear side of the apparatus.

Figure 9:
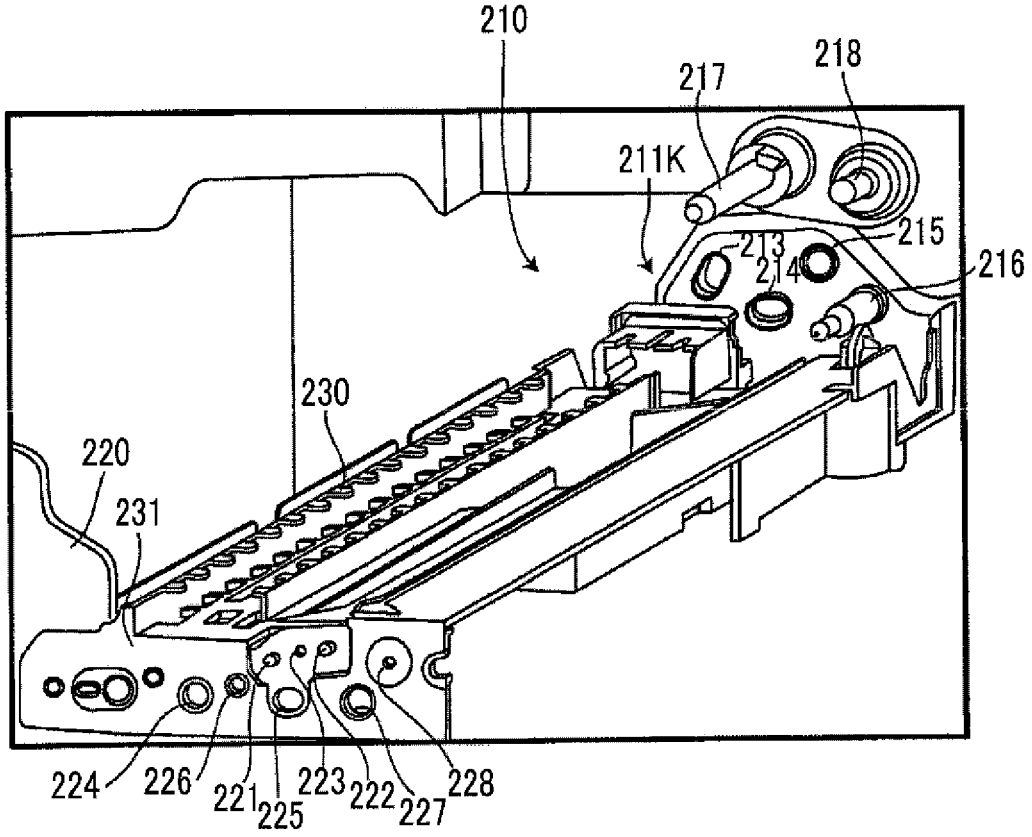
FIG. 9 is a perspective view illustrating a guide member which is installed at the frame member.

In addition, FIG. 9 is a perspective view illustrating the guide member in a state of being installed at the frame member. FIG. 9 illustrates a state in which a driving shaft 217 which rotatably drives the photoconductor 51K (refer to FIG. 2) and a coupling 218 which transmits a driving force to the developing device 54K (refer to FIG. 2) is installed directly over the positioning portion 211K of the metal plate 210. For the other three positioning portions 211Y, 211M and 211C, driving shafts for the photoconductors 51Y, 51M and 51C and couplings for the developing devices 54Y, 54M and 54C are installed in the same arrangement as the positioning portion 211K.

FIG. 9 illustrates the guide member 230 which hangs between the inner metal plate 210 and the front metal plate 220. The guide member 230 includes a positioning protrusion 232 (refer to FIG. 8) which is inserted into one positioning hole 212 among the four positioning holes 212, 213, 214 and 215 illustrated in FIG. 5, and the positioning protrusion 232 is inserted into the positioning hole 212 and is thus positioned. FIG. 9 illustrates only one positioning portion 211K among the four positioning portions 211Y, 211M, 211C and 211K illustrated in FIG. 4, but the guide member 230 is a member which spreads over the four positioning portions 211Y, 211M, 211C and 211K as illustrated in FIG. 3. Therefore, the guide member 230 includes a total of four positioning protrusions 232 which are respectively provided at the four positioning portions 211Y, 211M, 211C and 211K one by one and are inserted into a total of four positioning holes 212. The guide member 230 is positioned as a result of the four positioning protrusions 232 being inserted into the four positioning holes 212.

In addition, a butting portion 231 which butts the front metal plate 220 is provided at the guide member 230 on the front side thereof. When the positioning protrusion 232 (refer to FIG. 8) of the guide member 230 is inserted into the positioning hole 212, the butting portion 231 butts the front metal plate 220, and thus the guide member 230 is positioned in the insertion direction.

The front metal plate 220 is provided with the following structures for installing modules described later.

The metal plate 220 is provided with two bosses 221 and 222 which protrude forward, and a screw hole 223 is provided at a position interposed between the bosses 221 and 222. The bosses 221 and 222 and the screw hole 223 are structures for installing an exposure module 240 (refer to FIG. 10).

In addition, the metal plate 220 is provided with two positioning holes 224 and 225, and a screw hole 226 provided at a position interposed between the two positioning holes 224 and 225. The positioning holes 224 and 225 and the screw hole 226 are structures for installing a photoconductor module 250 (refer to FIG. 14).

Further, the metal plate 220 is provided with a positioning hole 227 and a screw hole 228. The positioning hole 227 and the screw hole 228 are structures for installing a developing module 260 (refer to FIG. 15).

Furthermore, the positioning holes 224, 225 and 227 provided in the metal plate 220 are holes which are formed through burring processing, but are holes which are formed through the burring processing from the front side of the metal plate 220 inward, have a shape protruding inward, and are not characteristic positioning structures in the present exemplary embodiment.

Figure 10:
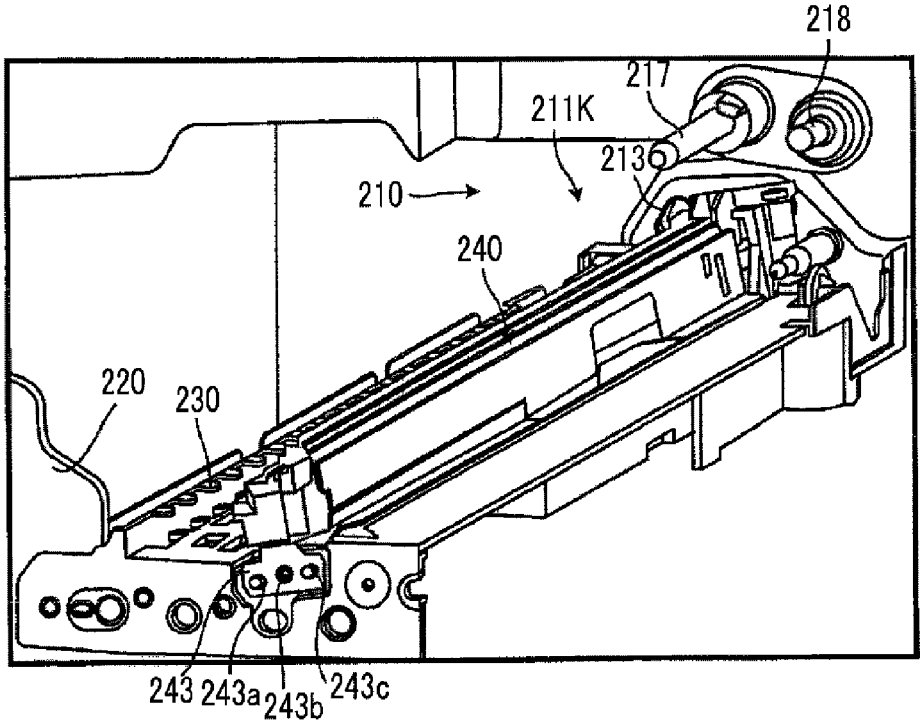
FIG. 10 is a perspective view illustrating an exposure module which is installed at the frame member.

FIG. 10 is a perspective view illustrating the exposure module in a state of being installed at the frame member.

The exposure module 240 is a module including the exposure device 53K illustrated in FIG. 2. The guide member 230 is installed as illustrated in FIG. 9, and then the exposure module 240 is guided by the guide member 230 and is installed by being slid from the front side inward. Two positioning protrusions 241 and 242 (refer to FIGS. 8 and 12) which are inserted into the two positioning holes 214 and 215 among the four positioning holes 212, 213, 214 and 215 illustrated in FIG. 3 are provided at a tip end portion of the exposure module 240 in the sliding direction. The exposure module 240 is positioned in a vertical direction and in a horizontal direction as a result of the two positioning protrusions 241 and 242 being inserted into the two positioning holes 214 and 215.

In addition, the exposure module 240 is provided with a butting portion 243 which butts the front metal plate 220 on a rear end side in the sliding direction. As a result of the butting portion 243 butting the front metal plate 220, the exposure module 240 is positioned in the sliding direction. The butting portion 243 has three holes 243*a*, 243*b* and 243*c*. The two bosses 221 and 222 provided at the metal plate 220 (refer to FIG. 9) enter the two holes 243*a* and 243*c* on both sides, and thus the exposure module 240 is positioned at the rear end portion in the sliding direction. The exposure module 240 is screwed to the screw hole 223 (refer to FIG. 9) by using the central hole 243*b* in this state.

Figure 11A:
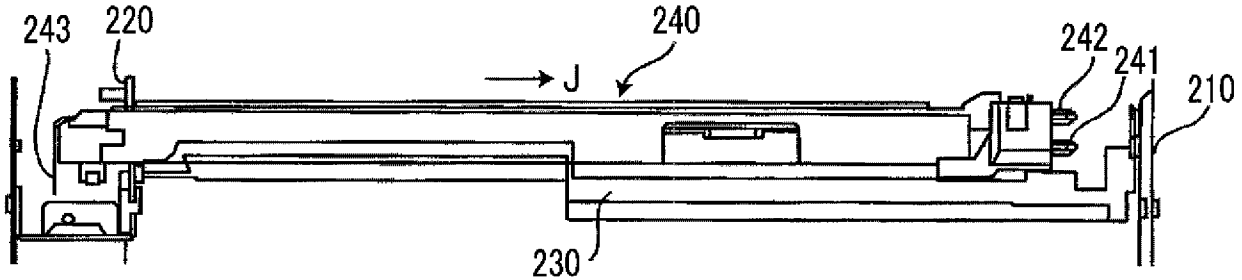
FIGS. 11A to 11C are schematic diagrams illustrating a state in which the exposure module is guided to the guide member and is slid.
Figure 11B:
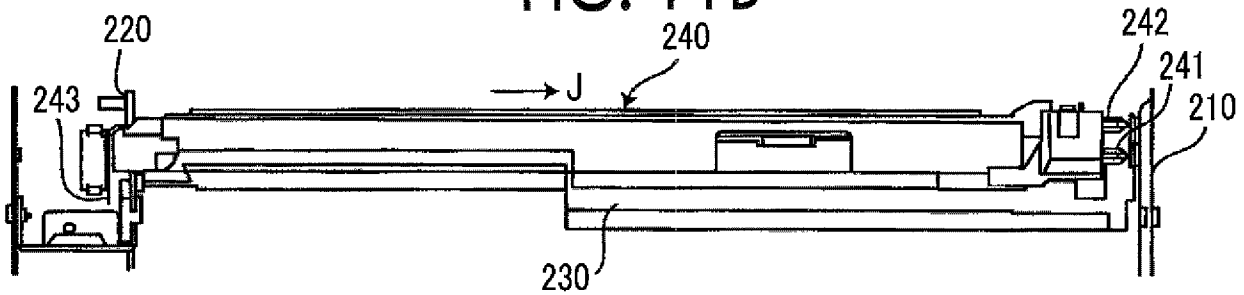
Figure 11C:
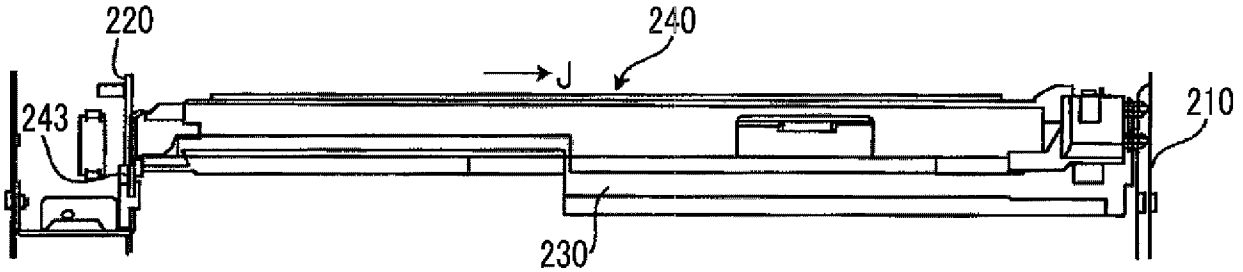

FIGS. 11A to 11C are schematic diagrams illustrating a state in which the exposure module is guided to the guide member and is slid. FIGS. 11A to 11C respectively illustrate a state in which sliding of the exposure module is in progress, a state right before the positioning protrusions 241 and 242 are inserted into the positioning holes 214 and 215 of the metal plate 210, and a state in which the positioning protrusions are inserted into the positioning holes.

Figure 12:
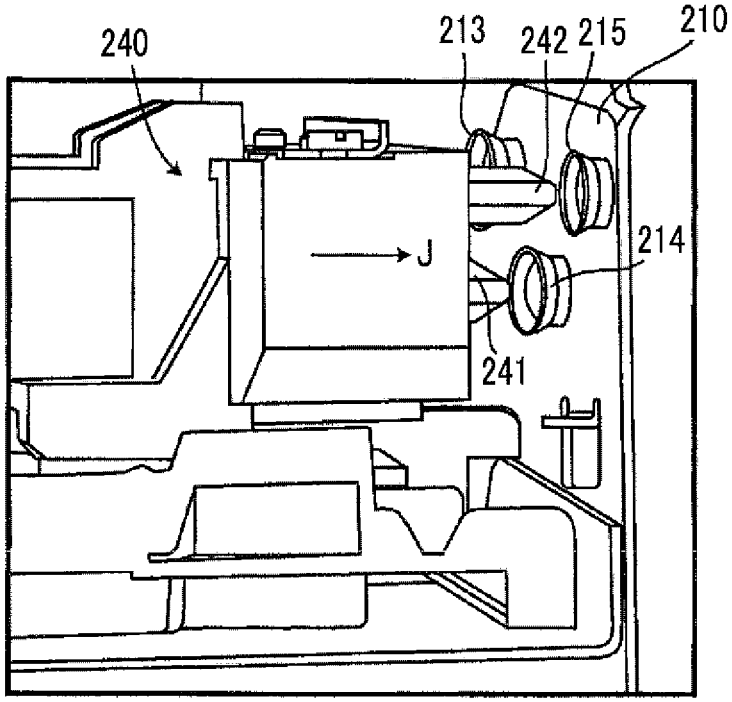
FIG. 12 is an enlarged perspective view of a tip end portion of the exposure module in a sliding direction.
Figure 13:
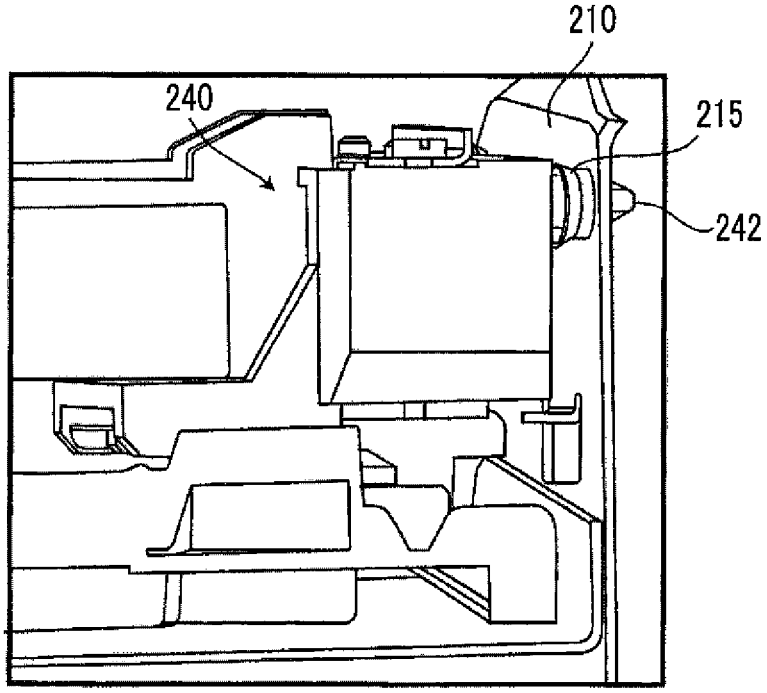
FIG. 13 is an enlarged perspective view of the tip end portion of the exposure module in a sliding direction.

FIGS. 12 and 13 are enlarged perspective views of the tip end portions of the exposure module in the sliding direction. FIGS. 12 and 13 respectively correspond to the states of FIGS. 11B and 11C.

The exposure module 240 is guided by the guide member 230 and is slid in an arrow J direction, and thus the two positioning protrusions 241 and 242 of the tip ends of the exposure module 240 in the sliding direction are inserted into the positioning holes 214 and 215 of the metal plate 210. In addition, at the same time as the insertion, the butting portion 243 on the rear end side in the sliding direction butts the metal plate 220. As mentioned above, the exposure module 240 is positioned in all of the horizontal direction, the vertical direction, and the sliding direction.

Figure 14:
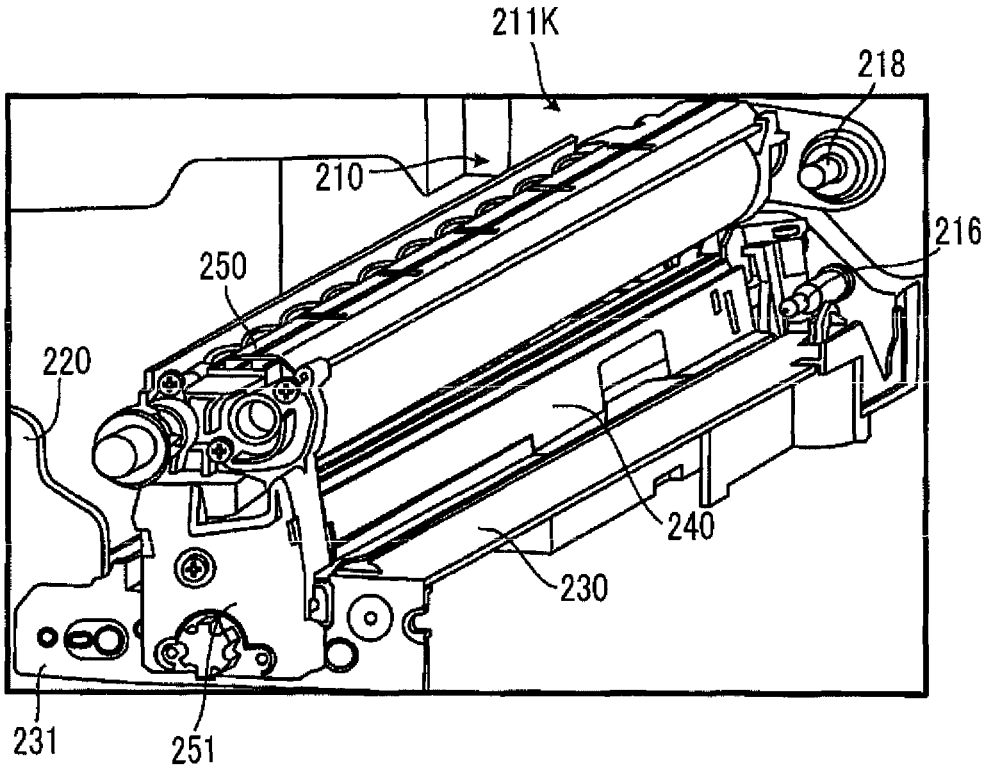
FIG. 14 is a perspective view illustrating a photoconductor module which is installed at the frame member.

FIG. 14 is a perspective view illustrating the photoconductor module in a state of being installed at the frame member. The photoconductor module 250 is a module including the photoconductor 51, the charger 52, and the cleaner 55 illustrated in FIG. 2. After the exposure module 240 is installed as illustrated in FIG. 10, the photoconductor module 250 is guided by the guide member 230 and is slid from the front side inward so as to be installed. The photoconductor module 250 is provided with a driving reception hole 252 (refer to FIG. 8) into which the driving shaft 217 is inserted and a positioning protrusion 253 (refer to FIG. 8) which is inserted into the positioning hole 213 on the tip end side thereof, and is positioned in the vertical direction and in the horizontal direction by the driving shaft 217 and the positioning hole 213. In addition, the photoconductor module 250 is provided with a butting portion 251 on a rear end side in the sliding direction, and is provided with two positioning protrusions (not illustrated) which are inserted into the two positioning holes 224 and 225 provided at the front metal plate 220 in the vicinity of the butting portion 251. The photoconductor module 250 is fixed by using the screw hole 226 illustrated in FIG. 8 when the butting portion 251 butts the metal plate 220 in a state in which the two positioning protrusions are inserted into the two positioning holes 224 and 225.

Figure 15:
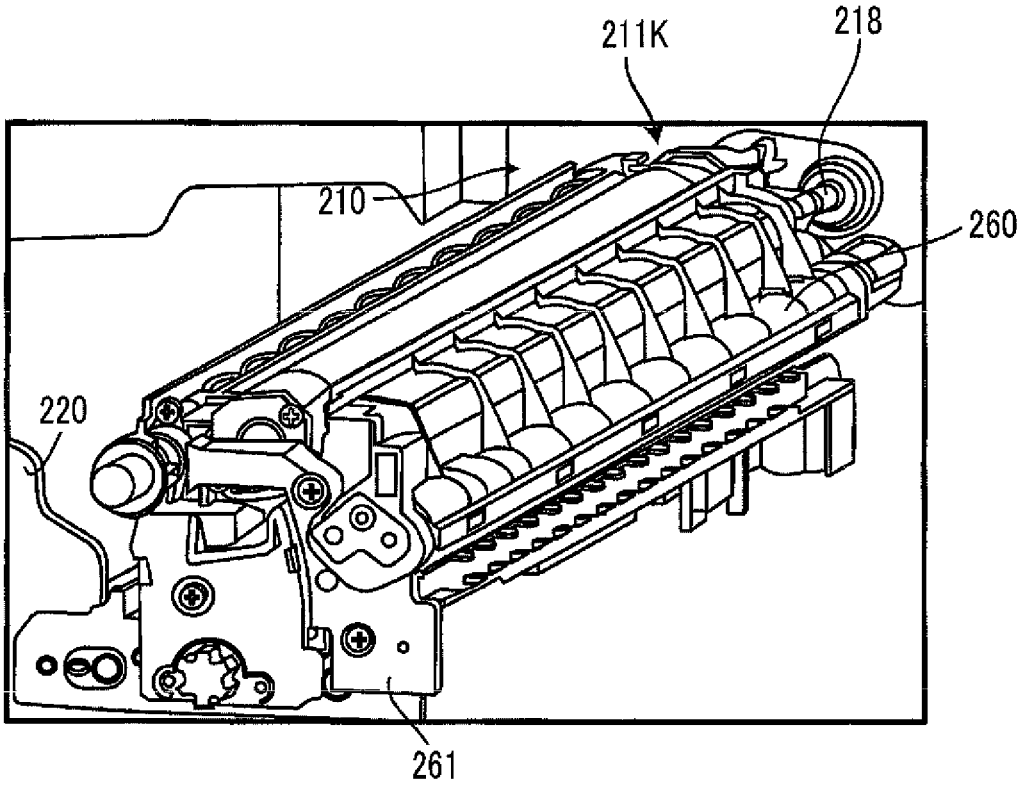
FIG. 15 is a perspective view illustrating a developing module which is installed at the frame member.

FIG. 15 is a perspective view illustrating the developing module in a state of being installed at the frame member.

The developing module 260 is a module including the developing device 54 illustrated in FIG. 2.

After the photoconductor module 250 is installed as illustrated in FIG. 14, the developing module 260 is guided by the guide member 230 and is slid from the front side inward so as to be installed. The developing module 260 is provided with a coupling 262 (refer to FIG. 8) which is coupled with the coupling 218 and a positioning hole 263 (refer to FIG. 8) which the positioning protrusion 216 (refer to FIG. 14) protruding from the metal plate 210 enters, on the tip end side in the sliding direction. In addition, the developing module 260 is provided with a butting portion 261 on the front side in the sliding direction, and is provided with a positioning protrusion (not illustrated) which enters the positioning hole 227 of the front metal plate 220 illustrated in FIG. 8 in the vicinity of the butting portion 261. The developing module 260 is screwed to the screw hole 228 illustrated in FIG. 9 when the butting portion butts the metal plate 220 in a state in which the positioning protrusion enters the positioning hole 227 (refer to FIG. 9) of the metal plate 220.

Here, the image forming unit 50 (refer to FIG. 2) is formed by three modules including the exposure module 240, the photoconductor module 250, and the developing module 260. In the present exemplary embodiment, among the three modules, the exposure module 240 and the photoconductor module 250 are installed by using the positioning holes 212, 213, 214 and 215 (refer to FIGS. 5 and 6) which are provided at the inner metal plate 210 in the sliding direction and have positioning structures unique to the present exemplary embodiment. For this reason, even the guide member 230 which is a low cost resin component with low positional accuracy of guide plays a sufficient role.

In addition, in the present exemplary embodiment, the photoconductor module 250, the exposure module 240, and the developing module 260 have been described to have attachable and detachable configurations, respectively, but, for example, the photoconductor module and the exposure module may be formed as an integral structure body.

Further, in the present exemplary embodiment, attachment and detachment of the fixing device 72 have not been described, but the above-described positioning structure may be employed in a case where the fixing device 72 is slid to be attached and detached. In this case, a positioning protrusion may be formed on a tip end side of the fixing device 72 in a sliding direction, and the positioning hole 212 for the fixing device 72 may be formed at the inner metal plate 210.

Further, in the present exemplary embodiment, the electrophotographic image forming apparatus has been exemplified, but the image forming apparatus mentioned in the present exemplary embodiment is not necessarily required to be the electrophotographic image forming apparatus, and may be image forming apparatuses of other types such as an ink jet printer.

Furthermore, in the present exemplary embodiment, description has been made of an example in which the positioning structure and the component installation structure of the present exemplary embodiment are applied to the image forming apparatus, but the present exemplary embodiment is applicable to general apparatuses which require positioning of a member or installation of a component during assembling even in apparatuses other than the image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a positioning structure into which a positioning protrusion provided at a member is inserted and which positions the member, wherein a metal plate comprises a body bounded by an inner surface and an outer surface, wherein the metal plate is provided with a hole which is processed to comprise a tip end portion (1) being separate from the body of the metal plate and (2) having a shape protruding away from the outer surface and the body of the metal plate and toward the positioning protrusion to be inserted therein, wherein the outer surface of the metal plate body is (1) separate from the tip end portion, and (2) closer to the positioning protrusion than the inner surface just prior to inserting the positioning protrusion in the hole, and wherein a protruding side of the tip end portion has a continuously and gradually increasing diameter as the tip end portion extends away from the outer surface and the body of the metal plate and extends directly to the hole, into which the positioning protrusion is inserted.

2. A component installation structure of an image forming apparatus, the component installation structure comprising:

a frame member;

a guide member that includes the positioning protrusion and guides a component installed on the frame member through sliding in a protruding direction of the positioning protrusion; and the metal plate that has the positioning structure according to claim 1 and is fixed at a backside of the frame member in a sliding direction when the component is installed, so that the positioning protrusion of the component is inserted into the hole.

3. The component installation structure according to claim 2, wherein the guide member includes the positioning protrusion protruding toward a tip end on the metal plate side, and wherein the metal plate is further provided with the hole into which the positioning protrusion of the guide member is inserted and which has the positioning structure.

4. The component installation structure according to claim 2, further comprising:

a butting member that butts a butting portion of the component provided at a rear end portion in a sliding direction when installed, so as to position the component in the sliding direction.

5. The component installation structure according to claim 3, further comprising:

a butting member that butts a butting portion of the component provided at a rear end portion in a sliding direction when installed, so as to position the component in the sliding direction.

6. An image forming apparatus in which a structure body that has at least some functions of forming an image and is attachable and detachable and which forms an image, wherein the image forming apparatus has the component installation structure according to claim 2, wherein the guide member guides sliding of the structure body, and wherein the metal plate is provided with a hole which has the positioning structure so as to position the structure body.

7. An image forming apparatus that forms an image based on a toner image fixed to a paper sheet, the image forming apparatus comprising:

a photoconductor module that includes a photoconductor which allows an electrostatic latent image to be formed thereon through irradiation with exposure light and a toner image to be formed thereon through development;

an exposure module that includes an exposure device which irradiates the photoconductor with exposure light; and a developing module that includes a developing device which develops an electrostatic latent image on the photoconductor with toner, wherein the image forming apparatus has the component installation structure according to claim 2, wherein the guide member guides sliding of each of three modules including the photoconductor module, the exposure module, and the developing module, and wherein the metal plate is provided with a hole which has the positioning structure to position at least one of the three modules.

8. The image forming apparatus according to claim 7, wherein the guide member includes a positioning protrusion protruding toward a tip end on the metal plate side, and wherein the metal plate is provided with a hole which has the positioning structure and into which the positioning protrusion of the guide member is inserted.

9. The image forming apparatus according to claim 7, wherein each of the three components including the photoconductor module, the exposure module, and the developing module includes a butting portion at a rear end portion separated from the metal plate, and wherein the image forming apparatus further includes a butting member that is common to the three components and butts the butting portion of each of the three components to position the three components in the sliding direction.

10. The image forming apparatus according to claim 8, wherein each of the three components including the photoconductor module, the exposure module, and the developing module includes a butting portion at a rear end portion separated from the metal plate, and wherein the image forming apparatus further includes a butting member that is common to the three components and butts the butting portion of each of the three components to position the three components in the sliding direction.

11. The image forming apparatus according to claim 9, wherein the guide member is positioned in the sliding direction by the butting member.

12. The image forming apparatus according to claim 10, wherein the guide member is positioned in the sliding direction by the butting member.

13. The image forming apparatus according to claim 1, wherein the tip end portion and the hole in which the positioning protrusion to be inserted consist of a continuous metal plate.

14. The image forming apparatus according to claim 1, wherein the protruding side of the tip end portion comprises (1) a first portion having a constant diameter for a predetermined length as the tip end portion extends away from the metal plate and (2) a second portion having the continuously and gradually increasing diameter which extends from the first portion.

15. An image forming apparatus that forms an image based on a toner image fixed to a paper sheet, the image forming apparatus comprising:

a photoconductor module that includes a photoconductor which allows an electrostatic latent image to be formed thereon through irradiation with exposure light and a toner image to be formed thereon through development;

an exposure module that includes an exposure device which irradiates the photoconductor with exposure light; and a developing module that includes a developing device which develops an electrostatic latent image on the photoconductor with toner, wherein the image forming apparatus has a component installation structure, wherein the guide member guides sliding of each of three modules including the photoconductor module, the exposure module, and the developing module, and wherein the metal plate is provided with a hole which has the positioning structure to position at least one of the three modules, wherein the component installation structure comprises:

a frame member;

a guide member that guides a component having a positioning protrusion, installed on the frame member through sliding in a protruding direction of the positioning protrusion; and a metal plate that has a positioning structure and is fixed at a backside of the frame member in a sliding direction when the component is installed, so that the positioning protrusion of the component is inserted into the hole, wherein positioning protrusion is inserted into the positioning structure, wherein the metal plate is provided with a hole which is processed to comprise a tip end portion having a shape protruding away from the metal plate and toward the positioning protrusion to be inserted therein and wherein a protruding side of the tip end portion has a continuously and gradually increasing diameter as the tip end portion extends away from the metal plate and into which the positioning protrusion is inserted.

* * * * *